US008228145B2

(12) United States Patent
Chung

(10) Patent No.: US 8,228,145 B2
(45) Date of Patent: Jul. 24, 2012

(54) INTEGRATED MAGNETIC SWITCH ASSEMBLY FOR A VEHICLE STARTER SOLENOID AND METHOD OF FORMING AN INTEGRATED MAGNETIC SWITCH ASSEMBLY

(75) Inventor: Jiwon Chung, Fishers, IN (US)

(73) Assignee: Remy Technologies, L.L.C., Pendleton, IN (US)

( * ) Notice: Subject to any disclaimer, the term of this patent is extended or adjusted under 35 U.S.C. 154(b) by 211 days.

(21) Appl. No.: 12/779,431

(22) Filed: May 13, 2010

(65) Prior Publication Data

US 2011/0279203 A1 Nov. 17, 2011

(51) Int. Cl.
*H01H 67/02* (2006.01)

(52) U.S. Cl. ..... 335/126; 335/205; 307/10.6

(58) Field of Classification Search ..... 335/126–131, 335/251, 205–207; 307/10.6
See application file for complete search history.

(56) References Cited

U.S. PATENT DOCUMENTS

| | | | | |
|---|---|---|---|---|
| 5,332,926 | A * | 7/1994 | Ueno et al. | 307/10.6 |
| 6,404,310 | B1 * | 6/2002 | Ando et al. | 335/133 |
| 7,038,563 | B2 * | 5/2006 | Andoh et al. | 335/126 |
| 7,570,138 | B2 * | 8/2009 | Hirabayashi | 335/131 |

* cited by examiner

*Primary Examiner* — Bernard Rojas
(74) *Attorney, Agent, or Firm* — Cantor Colburn LLP

(57) ABSTRACT

An integrated magnetic switch assembly includes a winding assembly portion having a housing, and a cover assembly mounted to the housing. The cover assembly includes at least one rivet terminal and at least one power terminal The at least one rivet terminal includes a body that extends through the cover assembly. The body has a first end that extends to a second end, and an opening that includes a first diameter that extends from the first end to the second end. A sealing member is positioned at the first end of the body about the opening of the at least one rivet terminal. The sealing member includes an opening having a second diameter that is smaller than the first diameter. A sealing element is positioned between the at least one power terminal and the cover assembly.

20 Claims, 5 Drawing Sheets

INTEGRATED MAGNETIC SWITCH ASSEMBLY FOR A VEHICLE STARTER SOLENOID AND METHOD OF FORMING AN INTEGRATED MAGNETIC SWITCH ASSEMBLY

BACKGROUND OF THE INVENTION

Exemplary embodiments pertain to the art of motor vehicle starters and, more particularly, to an integrated magnetic switch assembly for a motor vehicle starter.

Vehicle starter motors are typically provided with a pinion gear and a solenoid. A shift lever operatively connects the solenoid to the drive assembly. The solenoid typically includes a solenoid coil that is linked to a solenoid plunger. The plunger is linked to the pinion gear though a shift lever. When the solenoid coil is energized, the solenoid plunger extends thereby pivoting the shift lever. The shift lever urges the pinion gear into operative engagement with a flywheel member provided in a vehicle engine.

Vehicle starters that utilize a soft-start engagement system supply a substantial amount of current prior to the solenoid coil prior to shifting the pinion gear into engagement with the flywheel and rotating the vehicle motor. Typically, current supplied to the solenoid ranges from 200 amps to 400 amps depending on the particular starter motor and engine. This amount of current is much greater than the 4-6 amps that common ignition switches are capable of reliably handling. Therefore, soft-start engagement systems usually employ a separate integrated magnetic switch (IMS).

The IMS limits current draw of the starter motor to typical levels, e.g., in the rage of 2-4 amps. When the IMS is activated, a pull-in coil in the solenoid is connected to a vehicle battery. Current then flows to the starter motor allowing the pinion gear to rotate and engage the flywheel. In certain systems an IMS is mounted directly to the solenoid and starter motor. Vehicle starter motors are exposed to a wide variety of contaminates. Motor oil, water, dust and other substances coat the vehicle starter during operation. Over time, some of the contaminants leech into the vehicle starter and IMS. The contaminants entering into the IMS interfere with electric contacts as well as limit movement of the pull-in coil.

BRIEF DESCRIPTION OF THE INVENTION

Disclosed is an integrated magnetic switch assembly including a winding assembly portion having a housing, and a cover assembly mounted to the housing. The cover assembly includes at least one rivet terminal and at least one power terminal. The at least one rivet terminal includes a body that extends through the cover assembly. The body has a first end that extends to a second end, and an opening that includes a first diameter that extends from the first end to the second end. A sealing member is positioned at the first end of the body about the opening of the at least one rivet terminal. The sealing member includes an opening having a second diameter that is smaller than the first diameter. A sealing element is positioned between the at least one power terminal and the cover assembly.

Also disclosed is a method of forming a integrated magnetic switch assembly. The method includes passing a conductor from a winding assembly portion through a rivet terminal on a cover assembly. The rivet terminal includes a first opening having a first diameter. The method also includes passing the conductor through a sealing member provided on the rivet terminal. The sealing member includes a second opening having a second diameter. A power terminal is guided through the cover assembly. An interface between the power terminal and the cover assembly is sealed, and the winding assembly portion is joined to the cover assembly to form the integrated magnetic switch assembly.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
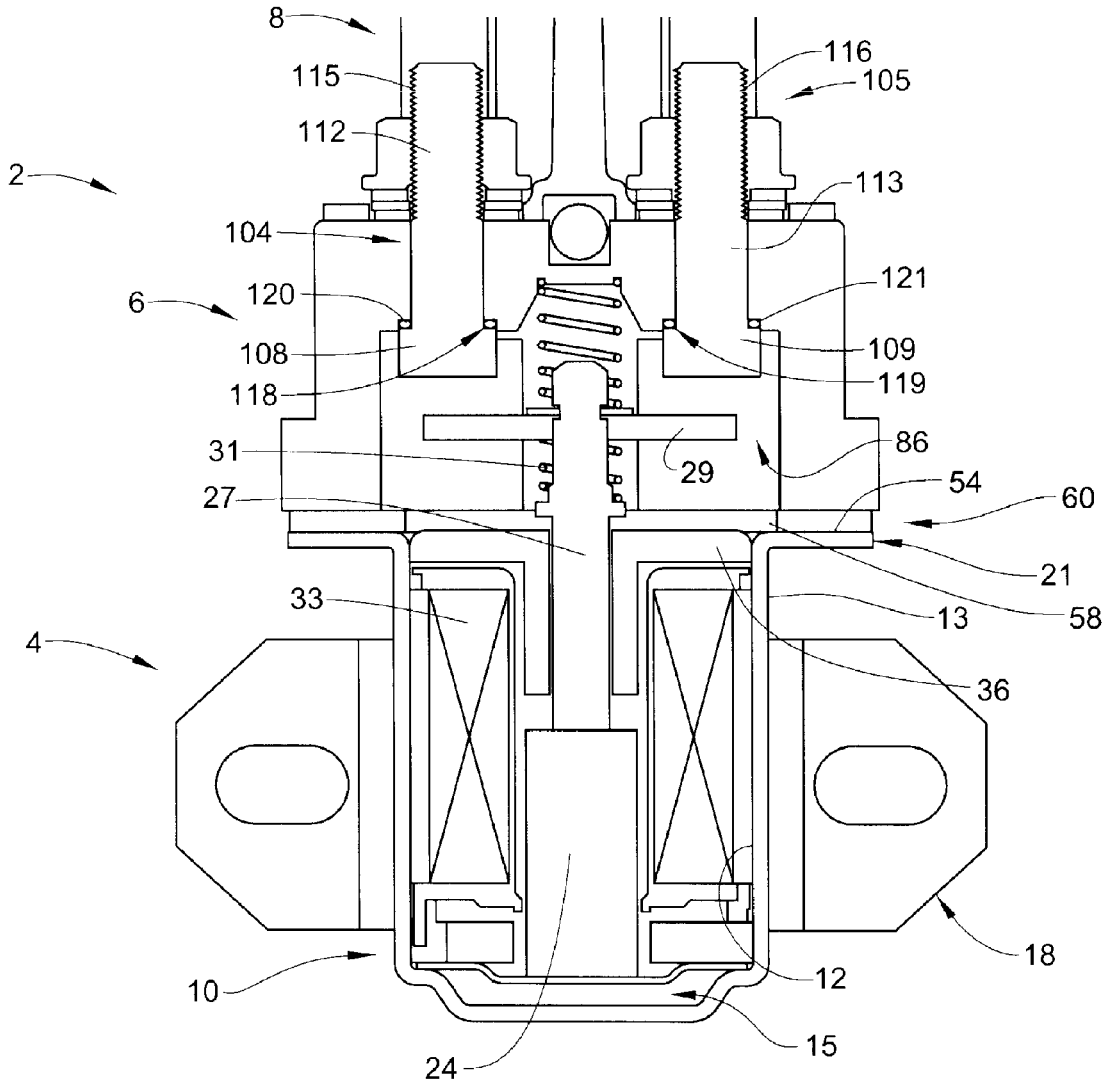
FIG. 1 is a plan view of an integrated magnetic switch (IMS) for a vehicle solenoid in accordance with an exemplary embodiment.

An integrated magnetic switch (IMS) assembly for a vehicle starter solenoid, constructed in accordance with an exemplary embodiment, is indicated generally at 2. IMS assembly 2 includes a winding assembly portion 4, a cover assembly 6, and an diode portion 8. Winding assembly portion 4 includes a housing 10 having an inner surface 12, an outer surface 13, and an interior portion 15. Housing 10 includes a mounting bracket 18 that is configured to be mounted to a vehicle starter (not shown). Housing 10 is also shown to include a mounting flange 21 which, as will be discussed more fully below, is configured to interface with cover assembly 6. Winding assembly portion 4 is also shown to include a solenoid plunger 24 having a plunger arm 27 that is selectively shiftable between a home position (shown in FIG. 1) and an extended position that is limited by a plunger contact or end stop 29. A return spring 31 is provided to return plunger arm 27 from the extended position to the home position. Plunger arm 27 is shifted by a magnetic force generated by a solenoid coil 33 that is provided with a cover 36.

Figure 2:
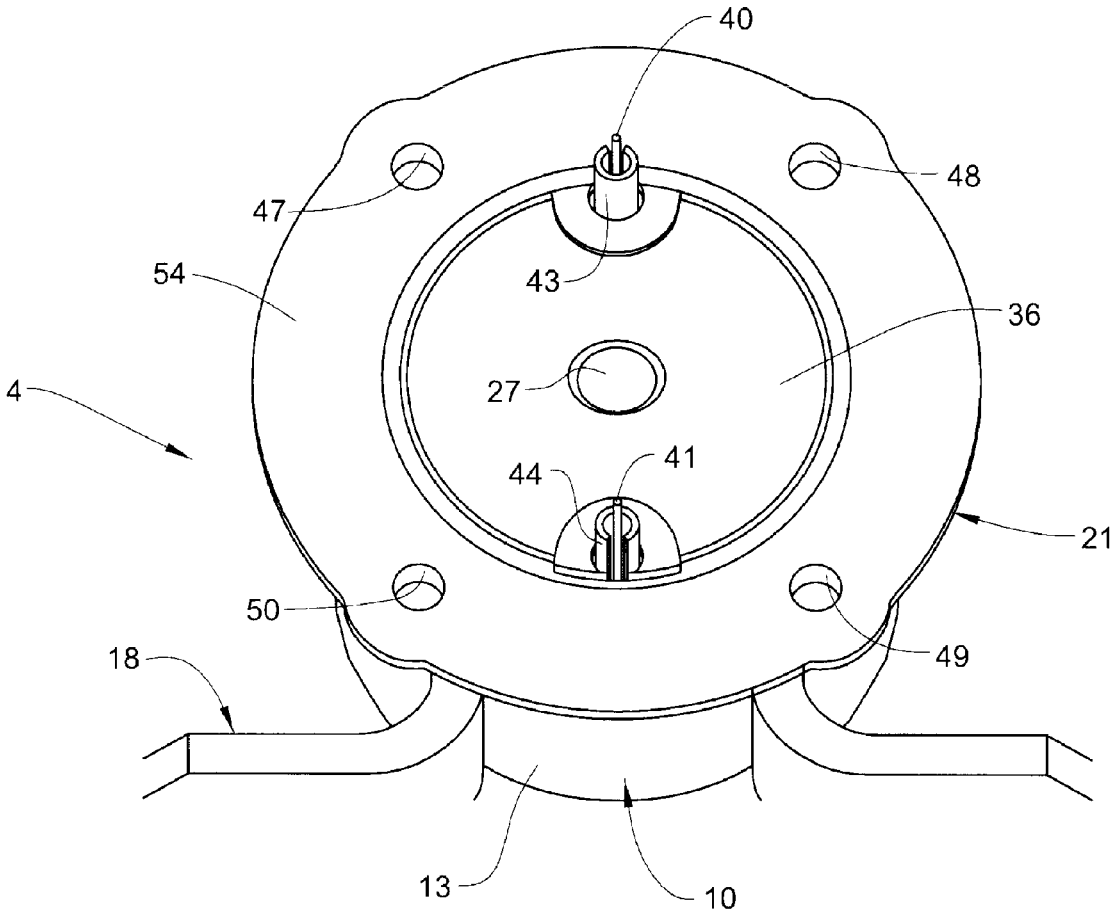
FIG. 2 is a perspective view of a winding assembly portion of the IMS of FIG. 1.
Figure 3:
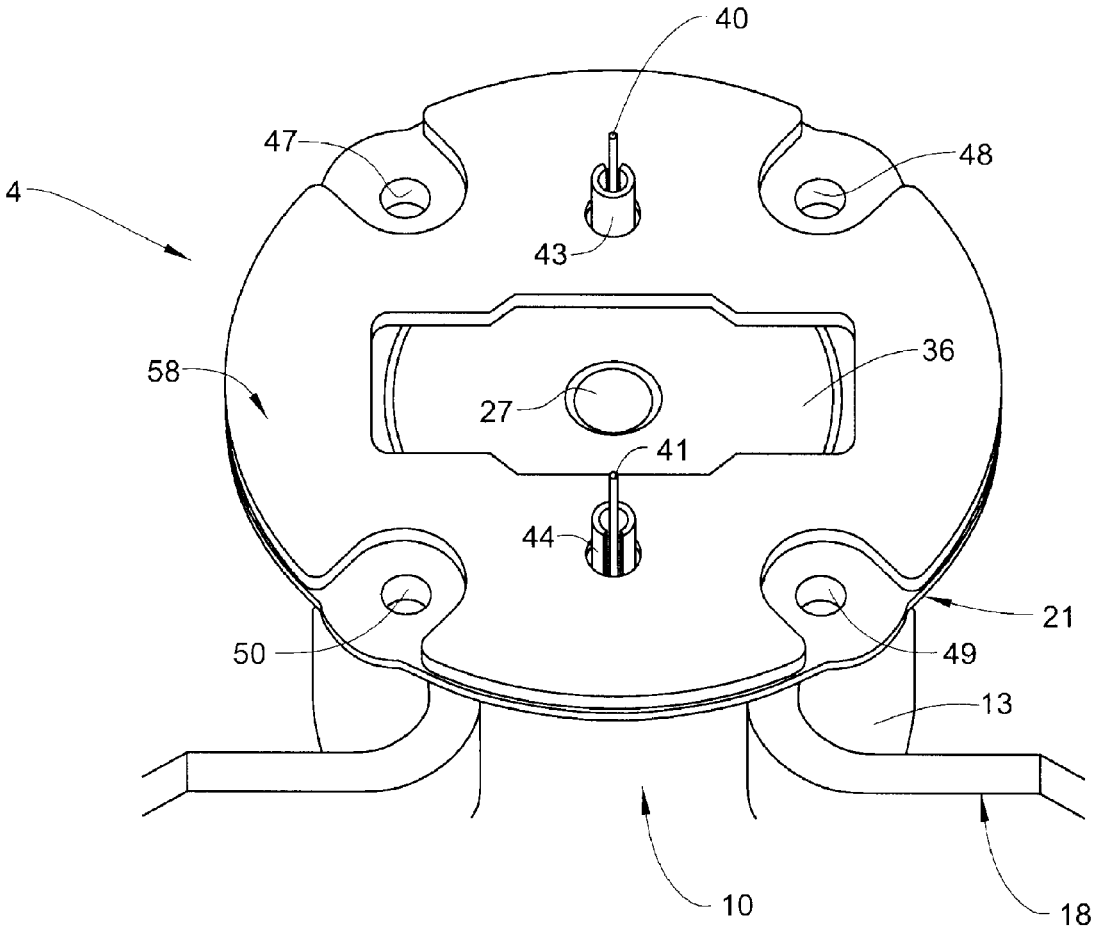
FIG. 3 is a perspective view of the end portion of the winding assembly portion of FIG. 2 illustrating a gasket mounted to a cover assembly interface surface.

As best shown in FIGS. 2-3, winding assembly portion 4 includes a first conductor 40 and a second conductor 41. First and second conductors 40 and 41 are electrically coupled to solenoid coil 33. Each conductor 40, 41 includes a corresponding insulator member 43 and 44. Insulator members 43 and 44 provide electrical insulation between conductors 40 and 41 and, for example, housing 10. Housing 10 is shown to include a plurality of openings 47-50 provided in mounting flange 21. Openings 47-50 extend about a sealing surface 54 of mounting flange 21. In accordance with the exemplary embodiment shown, a gasket 58 is provided on sealing surface 54. Gasket 58 prevents foreign debris from entering an interface 60 between winding assembly portion 4 and cover assembly 6.

Figure 4:
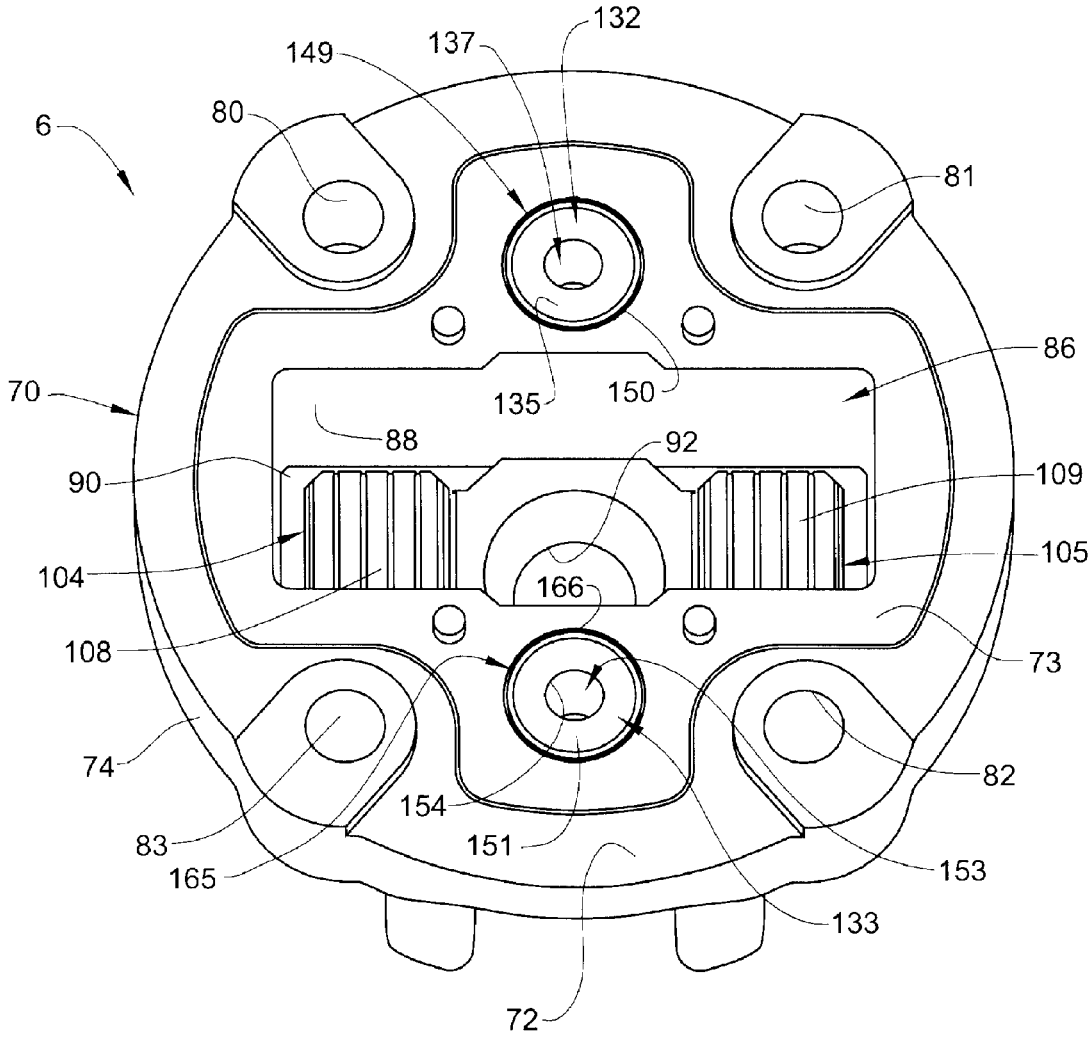
FIG. 4 is a lower perspective view of a cover assembly of the IMS of FIG. 1.
Figure 5:
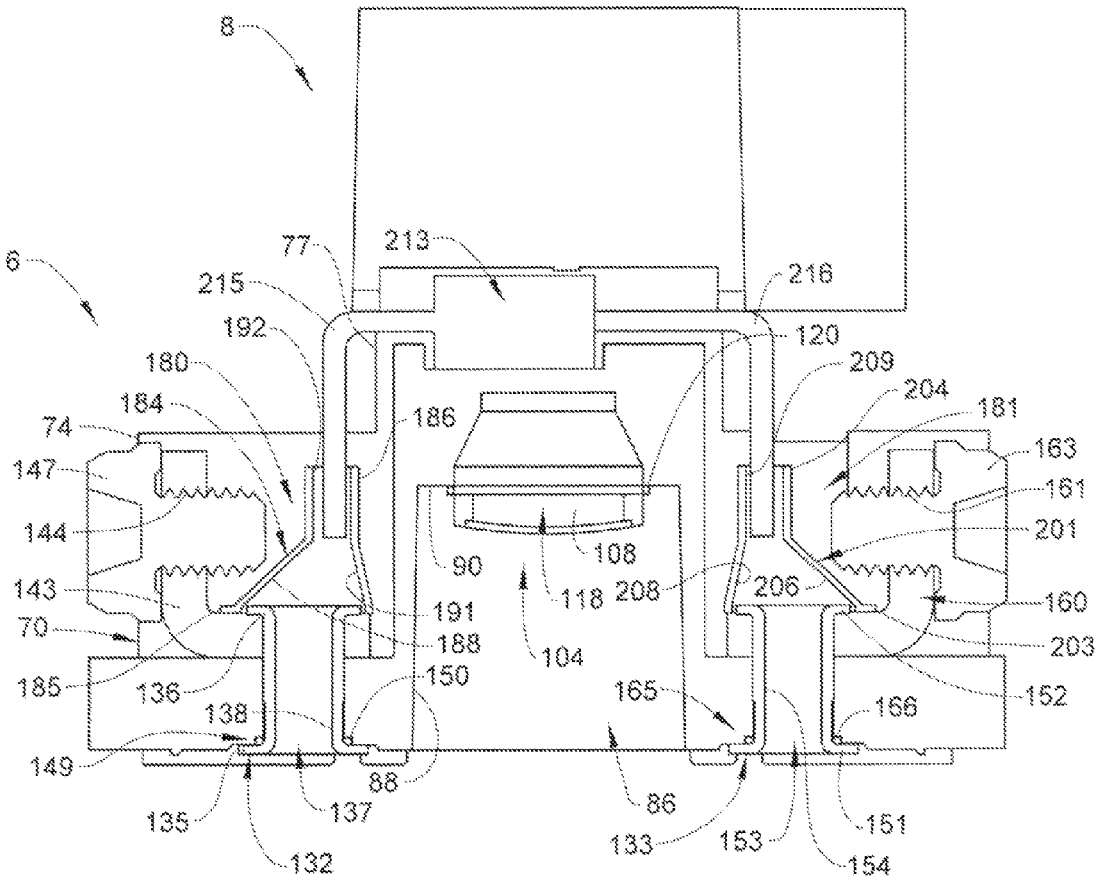
FIG. 5 is a elevational view of the cover assembly of FIG. 4.

Reference will now be made to FIGS. 4-5 in describing cover assembly 6 in accordance with an exemplary embodiment. Cover assembly 6 includes a body 70 having a sealing surface 72, a lower surface 73, an outer wall 74, and a terminal portion 77. Sealing surface 72 includes a plurality of openings

80-83 that are configured to register with openings 47-50 on housing 10 when cover assembly 6 is mated with sealing surface 54 of mounting flange 21. A plurality of mechanical fasteners (not shown) pass through respective, registered, openings 47-50 and 80-83 to secure cover assembly 6 to winding assembly portion 4. Cover assembly 6 is also shown to include a hollow interior section 86 having a side wall 88 and an inner end wall 90. Terminal portion 77 includes an outer end wall 91 that is positioned opposite inner end wall 90. An opening 92 extends through inner and outer end walls 90, 91 through terminal portion 77. Opening 92 provides a passage (not separately labeled) that allows solenoid plunger 24 to pass to diode portion 8.

Cover assembly 6 includes a first power terminal 104 and a second power terminal 105 that pass from hollow interior section 86 through inner and outer end walls 90, 91. Power terminals 104 and 105 are configured to be connected to a motor vehicle battery to supply power to a vehicle starter (not shown). Each power terminal 104, 105 includes a corresponding head portion 108, 109 and shank portion 112, 113. Each shank portion 112, 113 includes a plurality of threads 115 and 116. A first seal element 118 is positioned between head portion 108 of power terminal 104 and inner end wall 90. Similarly, a second seal element 119 is positioned between head portion 109 of power terminal 105 and inner end wall 90. In accordance with one aspect of the exemplary embodiment, first and second seal elements 118 and 119 take the form of resilient O-rings 120 and 121 that extend about shank portions 112, and 113, respectively. However, it should be understood by one of ordinary skill in the art that first and second seal elements can take on a variety of forms including both resilient and non-resilient seals. Seal elements 118 and 119 prevent foreign debris from entering into hollow interior section 86 and contaminating winding assembly portion 4 or other areas of IMS assembly 2.

Cover assembly 6 is also shown to include a first rivet terminal 132 and a second rivet terminal 133. Of course, it should be understood that first and second rivet terminals 132 and 133 can take on a variety of forms and should not be considered to be limited to rivets. First and second rivet terminals 132 and 133 are electrically coupled to first and second conductors 40 and 41 of winding assembly portion 4 as will become more fully apparent below. First rivet terminal 132 includes a first end 135 that extends to a second end 136. A passage 137 having an opening 138 extends between first and second ends 135 and 136. Opening 138 includes a first diameter configured to receive, for example, first conductor 40. First rivet terminal 132 is also connected to an L-shaped terminal 143 arranged at second end 136. L-shaped terminal 143 includes a connector receiving portion 144 that is configured to receive a mechanical fastener 147 that couples a conductor (not shown) to ring terminal 132. In the exemplary embodiment shown, first rivet terminal 132 is sealed against lower surface 73 by a first seal portion 149 which, in the exemplary embodiment shown, takes the form of a resilient O-ring 150. Of course, seal portion 149 could take on a variety of forms including both resilient and non-resilient seals.

Similarly, second rivet terminal 133 includes a first end 151 that extends to a second end 152. A passage 153 having an opening 154 extends between first and second ends 151 and 152. Opening 154 includes the first diameter configured to receive, for example, second conductor 41. Second rivet terminal 133 is also shown to be connected to an L-shaped terminal 160 arranged at second end 153. L-shaped terminal 160 includes a connector receiving portion 161 that is configured to receive a mechanical fastener 163 that couples a conductor (not shown) to second rivet terminal 133. In the exemplary embodiment shown, second rivet terminal 132 is sealed against lower surface 73 by a second seal portion 165 which, in the exemplary embodiment shown, takes the form of a resilient O-ring 166. Of course, seal portion 165 could take on a variety of forms including both resilient and non-resilient seals.

In further accordance with the exemplary embodiment, cover member 6 includes a first sealing member or ring terminal 180 positioned at second end 136 of first rivet terminal 132, and a second sealing member or ring terminal 181 positioned at second end 153 of rivet terminal 133. First sealing member 180 includes a body member 184 having a first end section 185 that extends to a second end section 186 through a tapered intermediate section 188. In accordance with one aspect of the exemplary embodiment, first sealing member 180 is formed from tin plated steel, however other materials can also be employed by one of ordinary skill in the art. First end section 185 includes a first opening 191 and second end section 186 includes a second opening 192. Second opening 192 includes a second diameter that is smaller than the first diameter. In contrast, first opening 191 of first sealing member 180 includes a third diameter. The third diameter is larger than the first diameter. In this manner, first sealing member 180 is configured with a funnel-like cross-section that aids passage of first conductor 40 through cover assembly 6. First sealing member 180 is secured about second end 136 of first rivet terminal 132 by, for example, brazing and/or welding. Of course, other methods of attachment could also be employed. In addition to, or as an alternative, first sealing member 180 is soldered to first rivet terminal 132.

In a manner similar to that described above, second sealing member 181 includes a body member 201 having a first end section 203 that extends to a second end section 204 through a tapered intermediate section 206. In accordance with one aspect of the exemplary embodiment, second sealing member 181 is formed from tin plated steel, however other materials can also be employed by one of ordinary skill in the art. First end section 203 includes a first opening 208 and second end section 204 includes a second opening 209. Second opening 209 includes a second diameter. The second diameter is smaller than the first diameter. In contrast, first opening 208 of second sealing member 181 includes a third diameter. The third diameter is larger than the first diameter. In this manner, second sealing member 181 is configured with a funnel-like cross-section that aids passage of second conductor 41 through cover assembly 6. In a manner similar to that described above, second sealing member 181 is secured about second end 152 of second rivet terminal 133 by brazing and/or welding. In addition to, or as an alternative, second sealing member 181 is soldered to second rivet terminal 133. A diode 213 is mounted between first and second sealing members 180 and 181. Diode 213 includes a first conductor 215 that passes through first opening 208 and a second conductor 216 that passes through second opening 209 and second end sections 186 and 204 are crimped and solder is applied. First and second conductors 215 and 216 are operatively connected to first and second conductors 40 and 41.

At this point it should be understood that the exemplary embodiments provide a integrated magnetic switch assembly for a vehicle starter that is sealed from foreign debris. The particular positioning of the seal elements about power terminals 104 and 105 prevents foreign debris such as dirt, oil, and/or other materials from entering into the cover assembly. In addition, the particular shape, construction and mounting of the first and second sealing members to the rivet terminals also prevents foreign debris from entering into vehicle starter solenoid assembly. That is, in contrast to prior arrangements in which connections vibrate loose to expose to foreign objects a large opening that leads to an internal area of the IMS assembly, first and second sealing members provide a more robust seal that prevents foreign object from entering into the IMS assembly.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. An integrated magnetic switch assembly for a vehicle starter comprising:

a winding assembly portion including a housing;

a cover assembly mounted to the housing, the cover assembly including at least one rivet terminal and at least one power terminal, the at least one rivet terminal extending through the cover assembly and including an end that extends to another end, the rivet terminal including an opening having a first diameter that extends from the end to the another end;

a sealing member positioned at the end of the rivet terminal about the opening, the sealing member including an opening having a second diameter that is smaller than the first diameter; and a sealing element positioned between the at least one power terminal and the cover assembly.

2. The integrated magnetic switch assembly of claim 1, wherein the sealing member includes a first end portion mounted to the cover assembly that extends to a second end portion through a tapering intermediate portion.

3. The integrated magnetic switch assembly of claim 2, wherein the first end portion includes an opening having a third diameter and the second end portion includes an opening having the second diameter, the third diameter being larger than the first diameter.

4. The integrated magnetic switch assembly of claim 2, wherein the sealing member is formed from a metallic substance.

5. The integrated magnetic switch assembly of claim 4, wherein the sealing member is formed from plated steel.

6. The integrated magnetic switch assembly of claim 1, wherein the power terminal includes a first end portion that extends to a second end portion through a diametric intermediate portion, the sealing element extending about the diametric intermediate portion.

7. The integrated magnetic switch assembly of claim 6, wherein the power terminal includes a head section that is positioned at a surface of the cover assembly, the second sealing member being arranged between the head section and the cover assembly.

8. The integrated magnetic switch assembly of claim 1, wherein the sealing element is an O-ring.

9. The integrated magnetic switch assembly of claim 8, wherein the O-ring is formed from a resilient material.

10. The integrated magnetic switch assembly of claim 1, further comprising: a gasket positioned between the winding assembly portion and the cover assembly.

11. The integrated magnetic switch assembly of claim 1, further comprising: a diode mounted to the cover assembly.

12. The integrated magnetic switch assembly of claim 1, further comprising: a seal portion positioned between the rivet terminal and the cover assembly.

13. The integrated magnetic switch assembly of claim 12, wherein the seal portion comprises an O-ring.

14. The integrated magnetic switch assembly of claim 13, wherein the O-ring is formed from a resilient material.

15. A method of forming an integrated magnetic switch assembly, the method comprising:

passing a conductor from a winding assembly portion through a rivet terminal on a cover assembly, the rivet terminal including a first opening having a first diameter;

passing the conductor through a sealing member provided on the rivet terminal, the sealing member including a second opening having a second diameter;

guiding a power terminal through the cover assembly;

sealing an interface between the power terminal and the cover assembly; and joining the winding assembly portion to the cover assembly to form the integrated magnetic switch assembly.

16. The method of claim 15, wherein passing the conductor through the sealing member includes passing the conductor along a tapered surface of the sealing member from the rivet terminal to the second opening.

17. The method of claim 15, wherein sealing the interface between the power terminal and the cover assembly includes installing an O-ring about the power terminal.

18. The method of claim 15, further comprising: securing the conductor to a diode assembly mounted to the cover assembly.

19. The method of claim 15, further comprising: sealing an interface between the winding assembly portion and the cover assembly.

20. The method of claim 15, further comprising: sealing an interface between the rivet terminal and the cover assembly.

* * * * *